United States Patent [19]

Yuasa

[11] 4,299,383

[45] Nov. 10, 1981

[54] TENNIS TRAINING DEVICE

[76] Inventor: Sueto Yuasa, 5-9-10, Seta, Setagaya-ku, Tokyo, Japan

[21] Appl. No.: 97,859

[22] Filed: Nov. 27, 1979

[30] Foreign Application Priority Data

Nov. 30, 1978 [JP] Japan ..... 53-165191[U]

[51] Int. Cl.[3] ..... A63B 61/00

[52] U.S. Cl. ..... 273/29 A; 124/51 A; 124/50; 124/78

[58] Field of Search ..... 273/29 R, 29 A, 26 D; 124/50, 51 A, 51 R, 48

[56] References Cited

U.S. PATENT DOCUMENTS

| | | | |
|---|---|---|---|
| 1,223,386 | 4/1917 | Handelan | 273/26 D |
| 2,087,575 | 7/1937 | Littell et al. | 124/51 A |
| 3,089,476 | 5/1963 | Wolverton | 124/51 A |
| 3,203,696 | 8/1965 | Sawyer | 273/29 R |
| 3,306,613 | 2/1967 | Mainers | 273/26 D |
| 3,308,802 | 3/1967 | Applegate | 124/50 |
| 3,724,437 | 4/1973 | Halstead | 273/26 D |
| 3,766,901 | 10/1973 | Cleary et al. | 273/29 A |
| 3,774,584 | 11/1973 | Paulson | 273/26 D |
| 3,785,358 | 1/1974 | D'Angelo et al. | 124/48 |
| 3,913,552 | 10/1975 | Yarur et al. | 124/50 |
| 3,989,245 | 11/1976 | Augustine et al. | 273/29 A |
| 3,989,246 | 11/1976 | Brown et al. | 273/29 A |
| 4,074,905 | 2/1978 | High | 273/26 D |
| 4,077,386 | 3/1978 | Berliner | 124/51 A |
| 4,094,294 | 6/1978 | Speer | 124/50 |
| 4,108,432 | 8/1978 | Clark | 273/29 A |

*Primary Examiner*—Richard C. Pinkham
*Assistant Examiner*—T. Brown
*Attorney, Agent, or Firm*—Thomas R. Morrison

[57] ABSTRACT

A tennis training device having ball emitting cylinder for cylically emitting tennis balls to a player's side, a ball collecting device for collecting tennis balls hit by a player, a ball control device for controlling horizontal and vertical angles of the ball emitting cylinder, a ball transfer device for transferring the tennis balls from the ball collecting device to the ball emitting cylinder and a ball distributing device located between the ball collecting device and the ball emitting cylinder for feeding the balls one by one to the ball emitting cylinder continuously with a constant time period between contiguous following balls.

5 Claims, 4 Drawing Figures

TENNIS TRAINING DEVICE

BACKGROUND OF THE INVENTION

1. Field of the Invention

This invention relates to a novel tennis training device having a ball distributing device.

2. Description of the Prior Art

In a training device adapted to emit a ball from a ball emitter to a player's side, many attempts have been made to positively distribute balls to a ball emitting cylinder one by one, but none has led to a fully satisfactory result.

OBJECTS AND SUMMARY OF THE INVENTION

An object of the present invention, therefore, is to provide a tennis training device comprising a novel ball distributing device including a ball distributor which positively distributes balls to a ball emitting cylinder one by one.

According to an aspect of the invention, a tennis training device is provided which comprises ball emitting means for cyclically emitting tennis balls to a player's side, ball collecting means for collecting tennis balls hit by a player, control means for controlling horizontal and vertical angles of said ball emitting means, ball transfer means for transferring said tennis balls from said ball collecting means to said ball emitting means, and ball distributing means located between said ball collecting means and said ball emitting means for feeding the balls one by one to said ball emitting means continuously with a constant time therebetween from said ball collecting means.

Further objects, features, and advantages of the invention will be fully understood from the following detailed description with reference to the accompanying drawings.

DETAILED DESCRIPTION OF THE PREFERRED EMBODIMENTS

Figure 1:
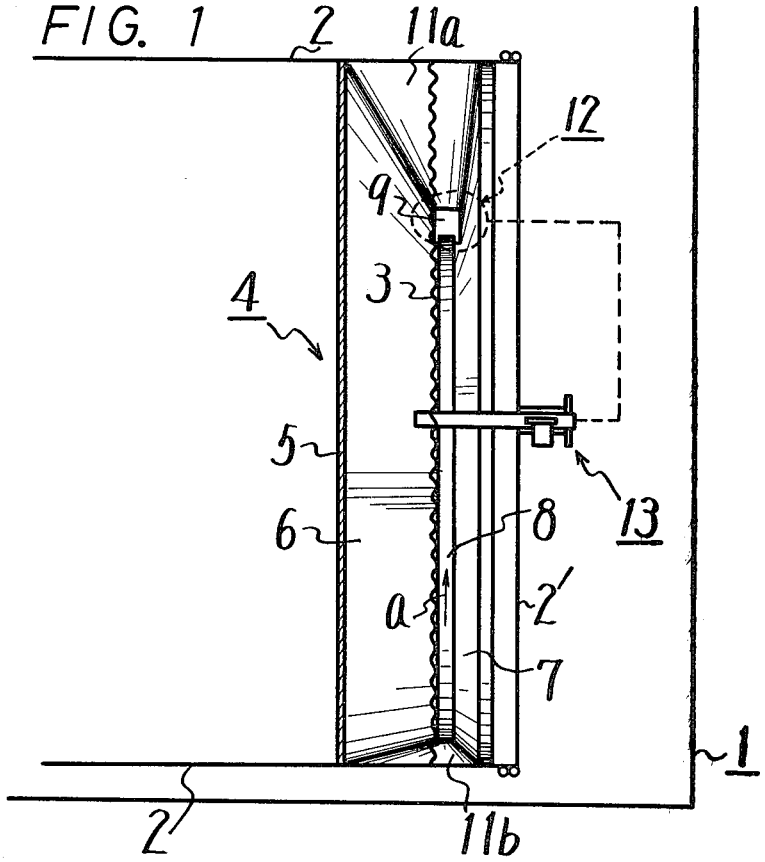
FIG. 1 is a diagrammatic plan view of essential parts of one embodiment of a tennis training device according to the invention.
Figure 2:
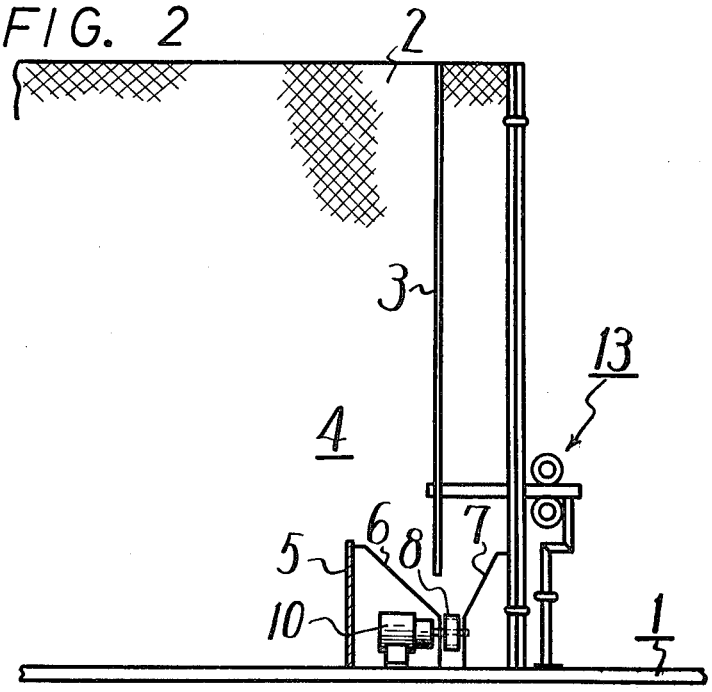
FIG. 2 is its partial longitudinal sectional view.

FIG. 1 is a diagrammatic plan view of parts of one embodiment of a tennis training device according to the invention and FIG. 2 is its longitudinal sectional view. Referring to FIGS. 1 and 2, reference numeral 1 designates a ground surface such as a concrete floor, tennis court or the like and 2 designates a surrounding net installed around the ground surface 1. Players stand at the left and in front of the surrounding net 2 in FIGS. 1 and 2 and train for various kinds of balls. A player's hit balls are transferred through a ball collector and ball distributor to a ball emitter, all of these measures being arranged in the rear of the surrounding net 2 and described hereinafter. The ball emitter functions to cyclically emit balls toward the player's side. Various kinds of such tennis training devices have heretofore been well known in the art.

In the present embodiment, provision is made of an undulated curtain 3 formed of a strong fiber sheet. The curtain 3 is spaced apart from a back net 2' of the surrounding net 2 and suspended from the top of the net 2. The curtain 3 functions to receive a ball hit by the player and to absorb the ball's energy, thereby dropping the ball along the front surface of the curtain 3.

Below the curtain 3 is arranged a ball collector 4 provided at its front with a target net 5. The ball collector 4 functions to transfer the dropped ball toward the left, for example, viewed from the front surface side.

The ball collector 4 is composed of a main inclined plate 6 extending downwardly from the upper edge of the target net 5 toward the rear surface side, an inclined plate 7 opposed to the main inclined plate 6 so as to define a substantially V-shaped transfer path, and a belt conveyor 8 arranged at the base of the substantially V-shaped transfer path. The main inclined plate 6 serves to guide the ball dropped thereon along the curtain 3 onto the belt conveyor 8 and then to a ball collecting hole 9 arranged at the end of the belt conveyor 8. In the present embodiment, the belt conveyor 8 is arranged parallel to the ground surface 1. Since the ball is forcedly transferred in a direction shown by an arrow a in FIG. 1 by means of the belt conveyor 8, the ball is transferred in a smooth manner.

In FIG. 2, reference numeral 10 designates a motor with a speed reduction gear for driving a main pulley of the belt conveyor 8. In FIG. 1, reference numerals 11*a* and 11*b* represent inclined plates adapted to close the left and right end portions of the ball transfer path, respectively.

Figure 3:
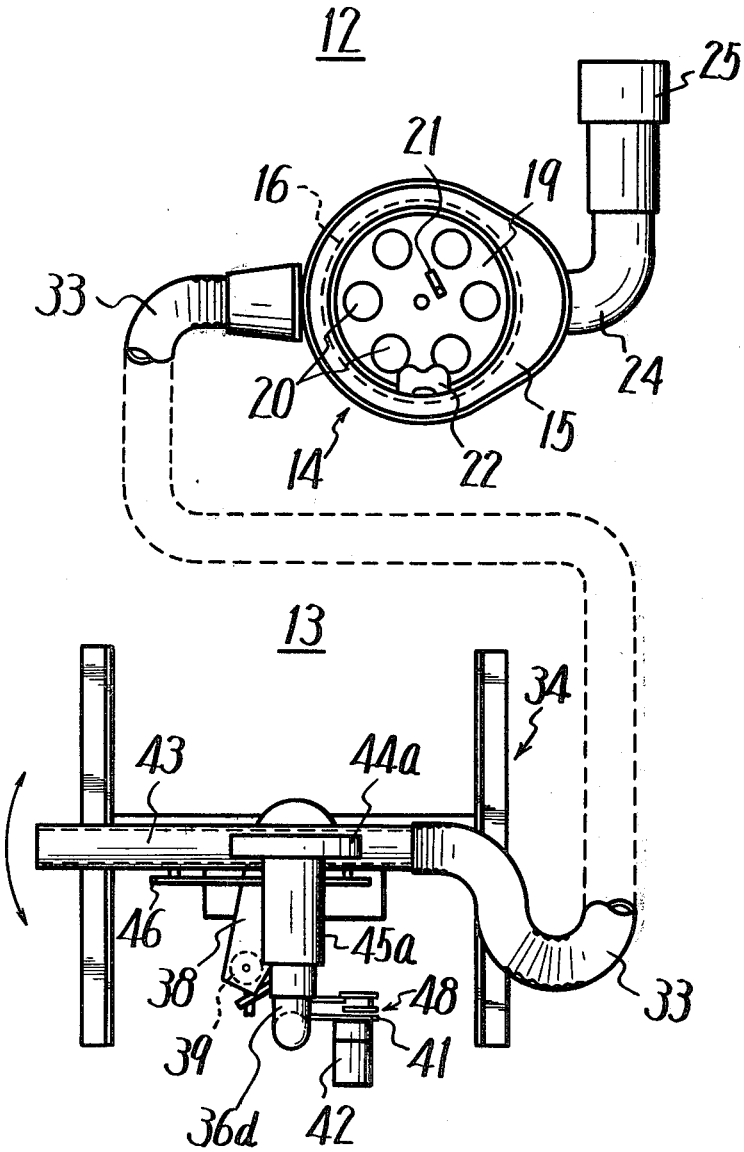
FIG. 3 is a plan view of a ball distributor and a ball emitter for a tennis training device according to the invention.

With the ball collector 4 are associated the ball distributor and ball emitter. In FIGS. 1 and 3, reference numeral 12 shows a ball distributor arranged below the ball collecting hole 9 and 13 a ball emitter extending through the center part of the back net 2' and the curtain 3. The ball distributor 12 and ball emitter 13 will now be described.

Figure 4:
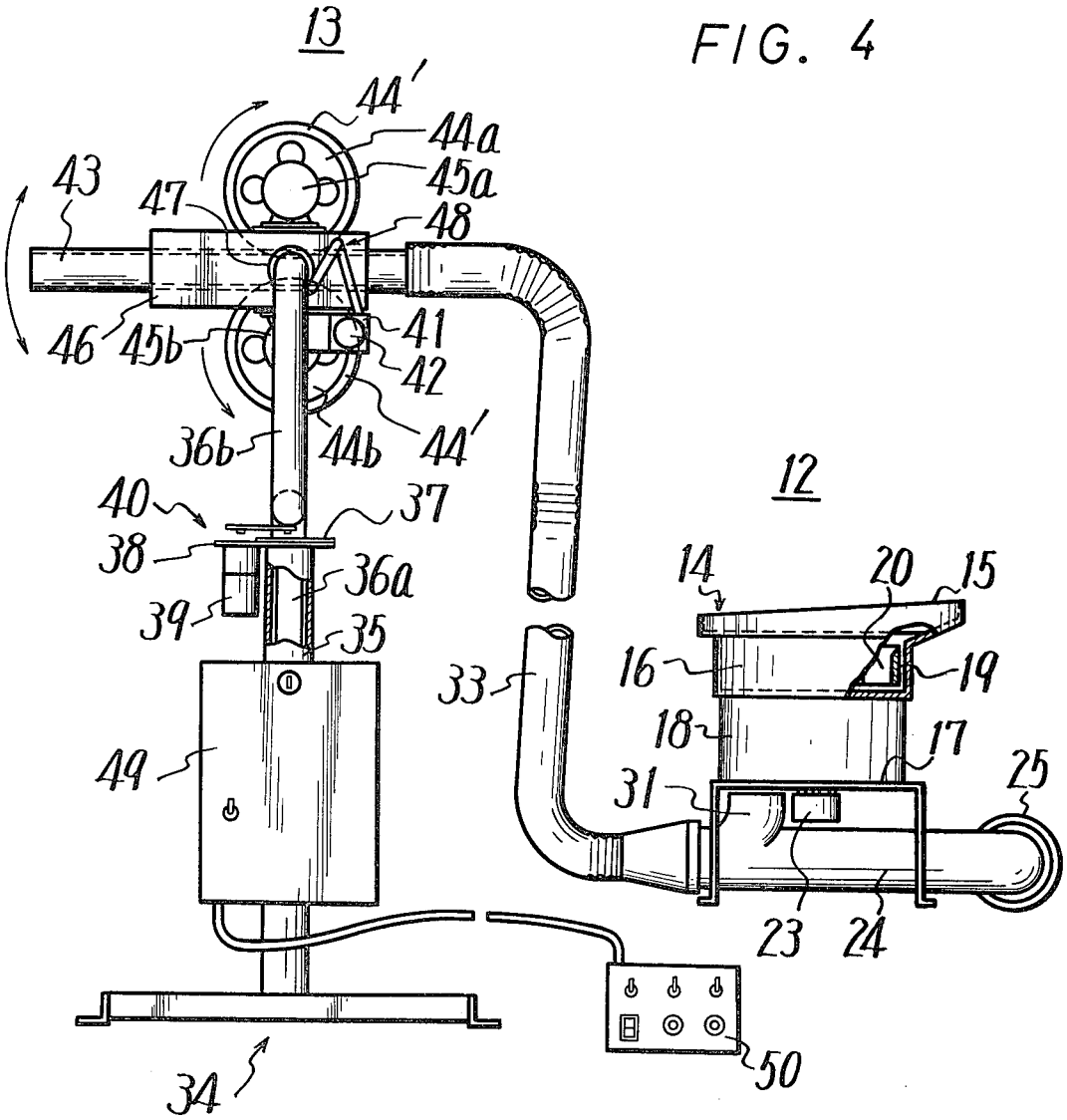
FIG. 4 is its side elevational view.

FIG. 3 is a plan view of the ball distributor 12 and ball emitter 13 and FIG. 4 is its side elevational view. In FIGS. 3 and 4, reference numeral 12 designates a ball distributor as a whole, 14 an upper body of the ball distributor 12 composed of a ball receiving hopper 15 and a circular ball receiving dish 16, 17 a supporting base, 18 a cylindrical frame for firmly securing the upper body 14 to the supporting base 17 and 19 a drum adapted to rotate in the receiving dish 16 at a low speed. The drum 19 is provided at its coaxial circle with an even number, for example, six punched bores 20 equidistantly separated from each other and extending through the drum 19.

Each punched bore 20 is adapted to permit a ball dropped from the above mentioned ball collecting hole 9 to enter thereinto one by one. The drum 19 is provided at its upper surface with a projection 21 formed, for example, of a triangular piece and is located at an eccentric position arranged inside the punched bores 20. The projection 21 is secured to the drum 19 and functions to agitate the dropped balls so as to separate them one from the other.

In FIG. 3, reference numeral 22 designates a ball control piece formed of a thin resilient plate and secured to the upper inner periphery of the ball receiving dish 16. The ball control piece 22 functions to permit the ball to enter one by one into a ball retaining cylinder to be described later.

In FIG. 4, reference numeral 23 designates a motor for driving the drum 19 and a rotary disc to be described later at a low speed, 24 a ball transfer joint pipe, and 25 a blower connected to the end of the ball transfer joint pipe 24.

Figure 5:
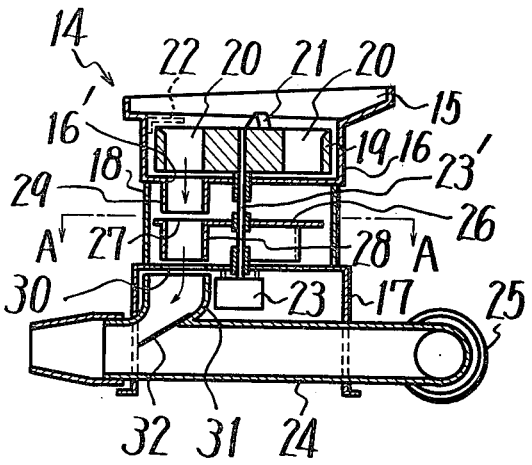
FIG. 5 is a longitudinal view of essential parts of the ball distributor shown in FIGS. 3 and 4.
Figure 6:
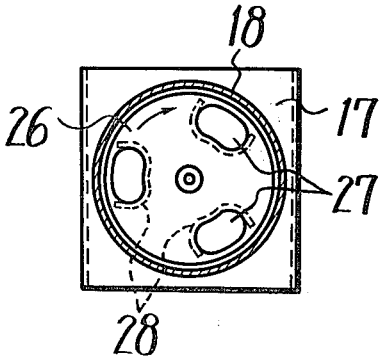
FIG. 6 is a section on line A—A of FIG. 5.

FIG. 5 is a longitudinal sectional view of the ball distributor 12 showing the internal construction of essential parts thereof and FIG. 6 is a section on the line A—A of FIG. 5. In FIGS. 5 and 6, parts corresponding to those shown in FIGS. 3 and 4 are designated by the same reference numerals. In FIGS. 5 and 6, reference numeral 26 designates the above rotary disc arranged in the cylindrical frame 18 and operative to move the ball. The rotary disc 26 and drum 19 are secured to a rotary driving shaft 23' of the motor 23 and driven in synchronism with each other. The rotary disc 26 is provided at its inner periphery with deformed elliptical bores 27 arranged along the same circle as that along which are arranged the punched bores 20. There are half as many of the bores 27 as there are of the punched bores 20, in the present embodiment, 3 in number and equidistantly spaced apart from each other. Substantially one half the periphery of each of the elliptical bores 27 is surrounded by a thin peripheral wall 28. The thin peripheral wall 28 is secured to that part of the lower surface of the rotary disc 26 which faces toward the center thereof and adapted to supply a ball into each of the elliptical bores 27.

The receiving dish 16 is provided at its base plate with a ball retaining cylinder 29 around a bore 16'. The ball retaining cylinder 29 is arranged at a position aligned with the elliptical bore 27 of the rotary disc 26 and corresponding to the ball control piece 22 and slightly spaced apart from the upper surface of the rotary disc 26. The supporting base 17 is provided at its upper plate with one opening 30 above which is passed the elliptical bore 27. To the opening 30 is opposed a communication cylinder 31 forming a part of the joint pipe 24. The communication cylinder 31 is provided at its base portion with a valve 32 formed of a thin rubber plate and secured to the communication cylinder 31 as shown in FIG. 5.

In the ball distributor 12 constructed as above described, balls received by the punched bores 20 of the drum 19 enters the retaining cylinder 29 one by one when the punched bore 20 is brought into alignment with the retaining cylinder 29. Subsequently, when the elliptical bore 27 of the rotary disc 26 is brought into alignment with the retaining cylinder 29, the ball is positioned at the inner peripheral wall 28 and transferred along the upper plate surface of the supporting base 17. When the ball arrives at the opening 30, the ball is dropped into the communication cylinder 31. The dropping energy of the ball causes the valve 32 to move downwardly into the joint pipe 24 at constant time intervals without interruption. Even if a ball fails to enter into any of the punched bores 20, the above mentioned arrangement of the drum 19, ball retaining cylinder 29, rotary disc 26 and opening 30 makes it possible to enter the ball into the punched bore 20 again and finally into the joint pipe 24.

As shown in FIGS. 3 and 4, the joint pipe 24 of the ball distributor 12 is connected through, for example, a flexible hose 33 to a ball emitter 13, more particularly a ball emitting cylinder to be described later. The ball dropped into the joint pipe 24 are transferred under wind pressure one by one by means of the blower 25.

Figure 7:
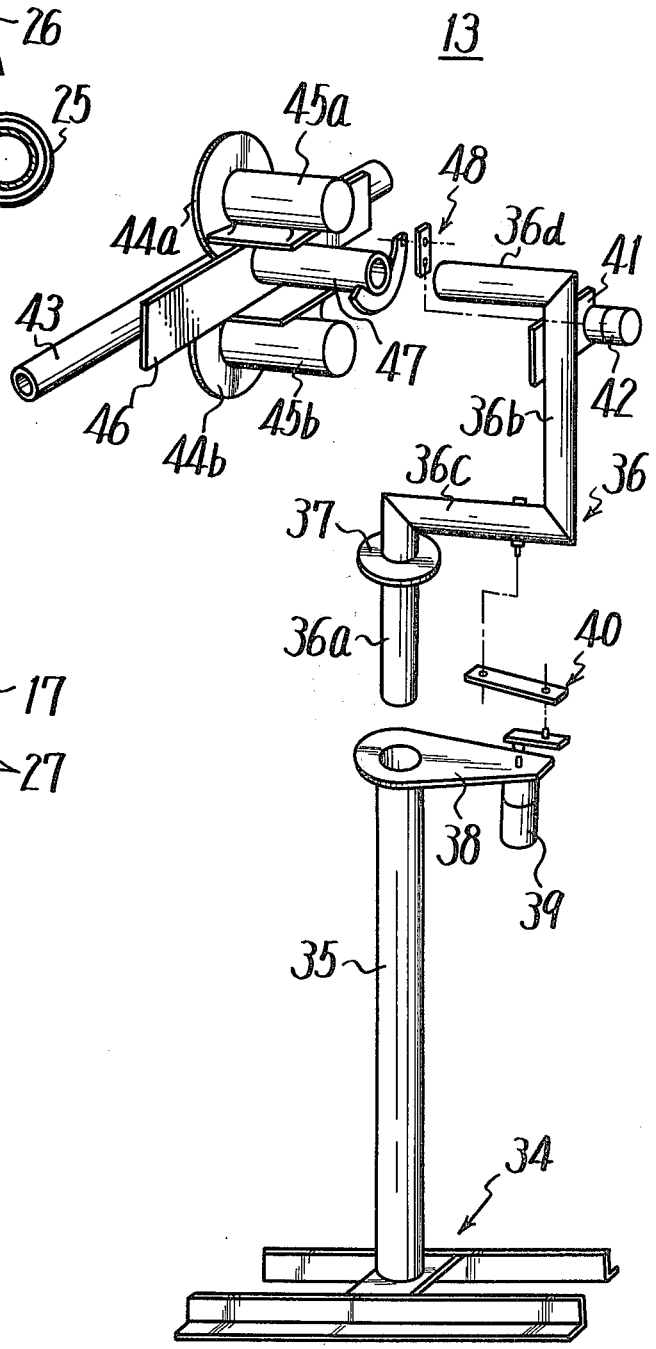
FIG. 7 is a fragmentary perspective view of the ball emitter shown in FIGS. 3 and 4.

FIG. 7 is a fragmentary perspective view of essential parts of the ball emitter. In FIGS. 3, 4 and 7, reference numeral 13 designates the ball emitter as a whole whose construction will be described mainly with reference to FIG. 7. In FIG. 7, reference numeral 34 designates a supporting base formed of channel steel, 35 a cylindrical column extending in a direction perpendicular to the supporting base 34, and 36 a crank member. The crank member 36 is composed of vertical portions **36*a*, 36*b* and horizontal portions 36*c*, 36*d*. The vertical portion 36*a* is rotatably journalled in the upper end of the cylindrical column 35 and provided with a flange 37 which functions as a stopper to limit the engaged position of the vertical portion 36*a*. Reference numeral 38 designates a fixture plate secured to the upper end of the cylindrical column 35 and supporting a first motor 39. The first motor 39 is secured to the lower surface of the free end of the fixture plate 38 and adapted to rotate the ball emitting cylinder in a horizontal direction. 40 shows a plurality of links adapted to connect the motor 39 to the horizontal portion 36*c* of the crank member 36 and to rotate the crank member 36 in a horizontal direction by means of the first motor 39, and 41 a fixture plate secured to the vertical portion 36*b* of the crank member 36 and supporting a second motor 42**.

The second motor 42 is secured to the right side surface of the fixture plate 41 and adapted to rotate the ball emitting cylinder to be described later in a vertical direction. The first motor 39 and the second motor 42 are low speed ones and rotatable in forward and reverse directions by changing over the inputs to these motors.

That is, the first motor 39 and the second motor 42 function to minutely control horizontally inclined angle and vertically inclined angle of the ball emitting cylinder to be described later, respectively. If the input to these motors is changed over, it is possible to reverse the rotation of these motors and hence to correct the inclined angle of the ball emitting cylinder in the opposite direction.

In FIGS. 3, 4 and 7, reference numeral 43 designates a ball emitting cylinder, **44*a* and 44*b* upper and lower ball emitting pulleys located at up and down sides of the cylinder 43 and each having a peripheral portion extended through a slit formed in the upper and lower peripheral surface of the ball emitting cylinder 43 thereinto, 45*a* and 45*b* upper and lower pulley driving motors, 46 a fixture base plate for supporting the ball emitting cylinder 43 and driving motors 45*a*, 45*b*, and 47 a cylinder secured to the center part, for example, of the fixture base plate 46. The cylinder 47 engages with or is connected to the horizontal cylindrical portion 36*d* of the crank member 36 and is connected through a plurality of links 48, which are substantially similar to the horizontally rotating links 40, to the vertically rotating motor 42, thereby providing the ball emitter 13** as a whole.

The respective members of the ball emitter 13 shown in FIGS. 3 and 4 are designated by like reference numerals showing the corresponding members of the ball emitter 13 shown in FIG. 7. The ball emitting ability and methods of adjusting the inclined angle in the horizontal and vertical directions of the ball emitting cylinder 43 or the like can be understood if referred to the above description. Each of the upper and lower ball emitting pulleys **44*a* and 44*b* is provided around its outer periphery with a rubber tire 44' engaged therewith. Since the peripheral speed of each pulley can be changed by controlling the input voltage applied to the driving motors 45***a* and 45*b*, the ball may be rotated and hence applied with a drive.

In FIG. 4, reference numeral 49 designates an electric supply source box secured to the cylindrical column 35 of the supporting base 34 of the ball emitter 13 for supplying currents to the above motors, and 50 a remote control panel including change-over switches or the like and for effecting the above mentioned various controls of the motors.

As stated hereinbefore, the tennis training device according to the invention is capable of controlling inclined angles of the ball emitting cylinder in any of horizontal and vertical directions and of remotely controlling the ball emitting cylinder in an easy and precise manner.

It will be apparent that many modifications and variations could be effected by one skilled in the art without departing from the spirits or scope of the novel concepts of the present invention so that the spirit or scope of the invention should be determined by the appended claims only.

I claim as my invention:

1. A tennis training device, comprising:

(a) ball emitting means for cyclically emitting tennis balls to a player's side;

(b) ball collecting means for collecting tennis balls hit by a player;

(c) control means for controlling horizontal and vertical angles of said ball emitting means;

(d) ball transfer means for transferring said tennis balls from said ball collecting means to said ball emitting means;

(e) ball distributing means located between said ball collecting means and said ball emitting means for feeding the balls one by one to said ball emitting means continuously with a constant time period between contiguous balls; and (f) said ball distributing means including a ball receiving dish, a drum rotatably located in said dish and having a plurality of bores located on a coaxial circle of said drum for temporarily holding said tennis balls therein from said ball collecting means, a ball retaining cylinder projecting down from a bore in the bottom of said dish, a rotary disc located beneath said ball retaining cylinder and having half as many elliptical bores therein as the number of said bores in said drum, and a supporting base supporting said dish, drum and rotary disc and having an opening which is aligned with said ball retaining cylinder, whereby the tennis balls from said ball collecting means pass through said bores in said drum, the bore in said dish, said ball retaining cylinder, said elliptical bores and the opening of said supporting base to said ball transfer means.

2. A tennis training device as claimed in claim 1, in which said ball receiving dish has a ball control means at an inner periphery thereof and above said drum so as to feed the balls from said ball collecting means to said ball retaining cylinder one by one.

3. A tennis training device as claimed in claim 1, in which said supporting base has supported therein a motor for rotating said drum and said rotary disc.

4. A tennis training device as claimed in claim 1, further comprising a communication pipe for transferring said balls from said ball distributing means to said ball transfer means.

5. A tennis training device as claimed in claim 4, further comprising a blower for transferring the balls from said ball distributing means through said pipe.

* * * * *